United States Patent [19]

Goodfellow

[11] Patent Number: 4,483,174

[45] Date of Patent: Nov. 20, 1984

[54] METHOD FOR CONTROLLING PROPERTIES OF POWDERED METALS AND ALLOYS

[75] Inventor: Glenn B. Goodfellow, Franklin Lake, N.J.

[73] Assignee: UTI Corporation, Collegeville, Pa.

[21] Appl. No.: 566,060

[22] Filed: Dec. 27, 1983

Related U.S. Application Data

[63] Continuation-in-part of Ser. No. 451,136, Dec. 20, 1982, Pat. No. 4,462,232.

[51] Int. Cl.[3] ..... B21D 22/00

[52] U.S. Cl. ..... 72/358; 72/377

[58] Field of Search ..... 72/353, 354, 357, 358, 72/360, 361, 377

[56] References Cited

U.S. PATENT DOCUMENTS

| | | | |
|---|---|---|---|
| 3,167,859 | 2/1965 | Bailey . | |
| 3,209,453 | 10/1965 | Bertoglio et al. . | |
| 3,832,763 | 9/1974 | Schober . | |
| 4,045,644 | 8/1977 | Shafer et al. . | |
| 4,299,112 | 11/1981 | Kondo | 72/358 |

*Primary Examiner*—Leon Gilden

*Attorney, Agent, or Firm*—Seidel, Gonda & Goldhammer

[57] ABSTRACT

A method for increasing strength and/or hardness of a sintered powder metal specimen containing tungsten by cold working is disclosed. Compressive force is applied to the specimen slowly so that the yield strength of the specimen progressively increases and the specimen exhibits squirming instability as its diameter increases.

17 Claims, 14 Drawing Figures

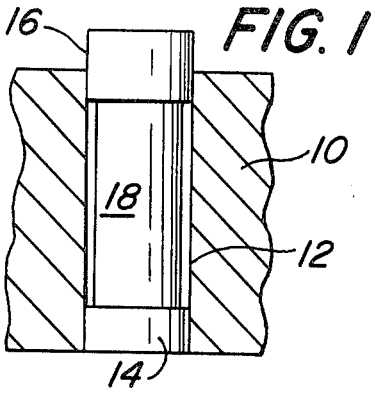
FIG. 1
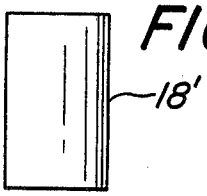
FIG. 2
FIG. 3
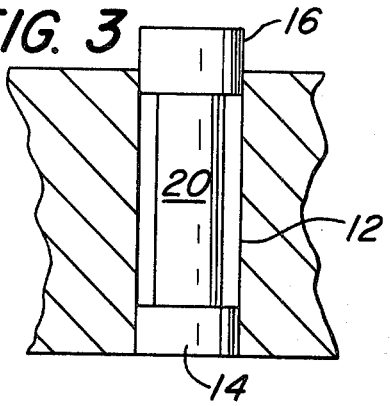
FIG. 4
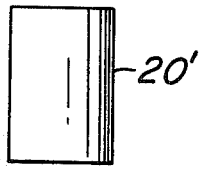
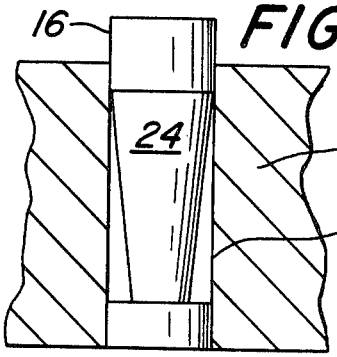
FIG. 5
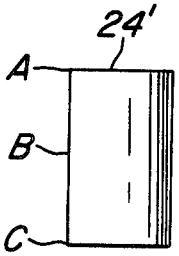
FIG. 6
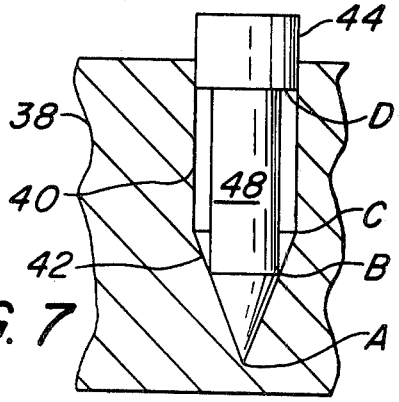
FIG. 7
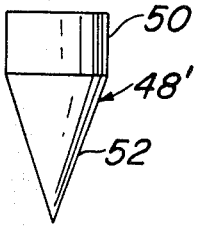
FIG. 8

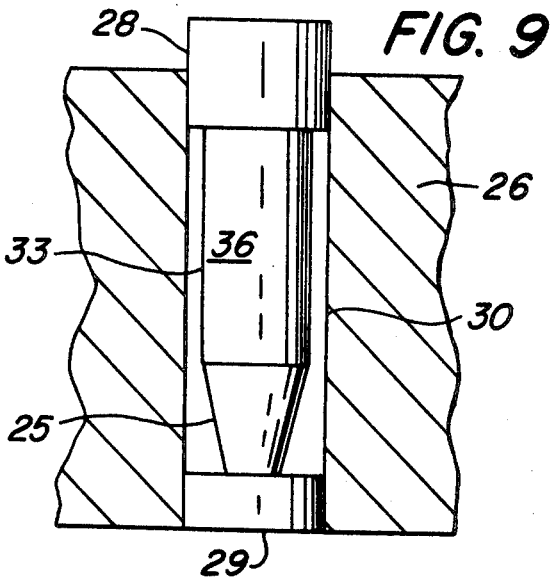
FIG. 9
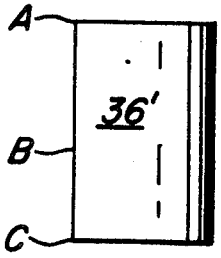
FIG. 10
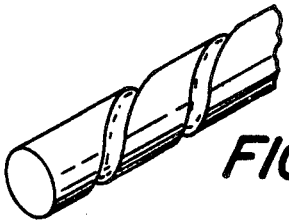
FIG. 11
FIG. 12
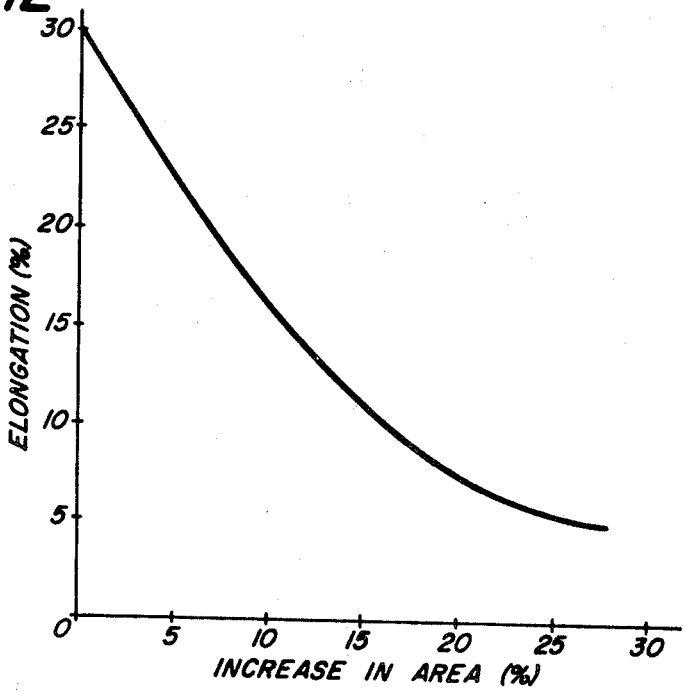

FIG. 13
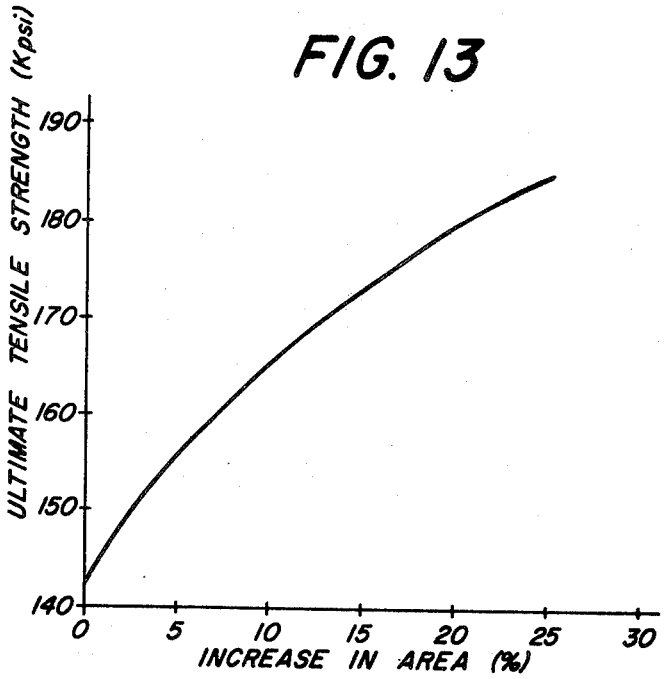
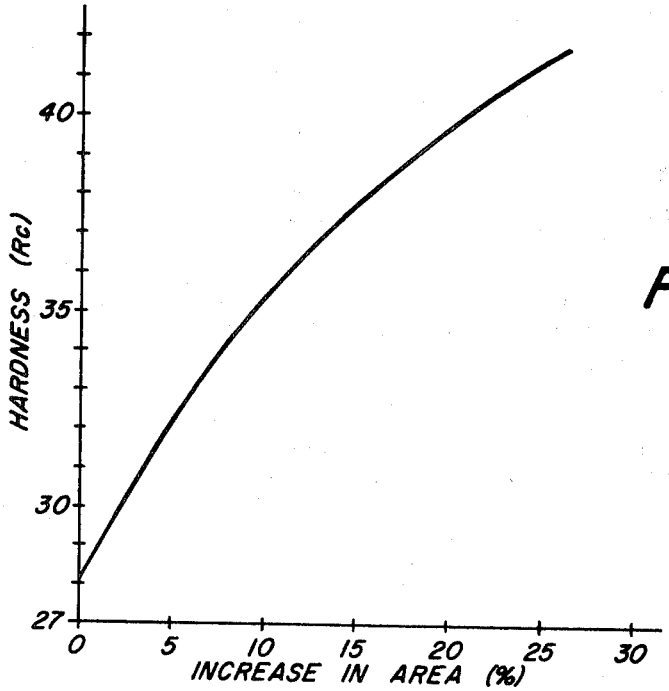
FIG. 14

METHOD FOR CONTROLLING PROPERTIES OF POWDERED METALS AND ALLOYS

RELATED CASES

This application is a CIP of application No. 451,136 filed Dec. 20, 1982 now U.S. Pat. No. 4,462,232 and entitled Method For Controlling Properties Of Metals And Alloys.

BACKGROUND OF THE INVENTION

It is old and well known in the art of metal working to cold work metals and alloys. It is known from U.S. Pat. No. 3,209,453 to shape a blank in a die prior to finish machining. It is known from U.S. Pat. No. 4,045,644 to apply axial pressure on a sintered electrode blank to pressure flow the blank radially to reorientate the grain structure.

It would be highly desirable if one could control mechanical properties of powder metals in a predictable manner so as to attain, for example, a powder metal product having predetermined variable hardness along its entire length or along only a portion of its length. The present invention is directed to attaining that goal.

SUMMARY OF THE INVENTION

The present invention is directed to a method for increasing strength and/or controlling mechanical properties of metals and alloys in a predictable manner. A specimen is produced with a preshape and dimensions determined on the basis of the desired strength or mechanical properties with the specimen length being substantially greater than the transverse dimensions. The preshaped specimen made from a powdered metal such as tungsten is introduced into a confined chamber which defines the desired final shape. At least a portion of the specimen is spaced from the periphery of the walls defining the chamber with the relative dimensions of the spacing being governed by the amount of cold work needed to achieve desired strength or mechanical properties in that portion of the specimen.

One face of the specimen is engaged with a moveable wall of the chamber. The moveable wall of the chamber applies a continuous compressive force with a sufficient magnitude so as to force the preshaped specimen to deform and fill the chamber at the end of the compressive stroke while simultaneously decreasing length and maintaining the volume of the specimen constant. The compressive force is applied sufficiently slowly so that the yield strength of the preshaped specimen progressively increases. At the same time, the compressive force progressively increases as the yield strength increases until the entire circumference of the specimen contacts the walls of the chamber and attains said desired final shape at the end of the compressive stroke.

It is an object of the present invention to provide a method for controlling the strength and/or mechanical properties of powder metals and alloys by cold working a preformed specimen in a closed chamber.

It is another object of the present invention to provide a method for predictably controlling mechanical properties such as hardness along the length or breath of a specimen.

Other objects and advantages will appear hereinafter.

DESCRIPTION OF THE DRAWINGS

FIG. 1 is a sectional view of a closed die containing a specimen.

FIG. 2 is an elevation view of the specimen in FIG. 1 after it has been shaped.

FIG. 3 is a sectional view of a closed die containing another specimen.

FIG. 4 is an elevation view of the specimen in FIG. 3 after it has been shaped.

FIG. 5 is a sectional view of a closed die containing another specimen.

FIG. 6 is an elevation view of the specimen in FIG. 5 after it has been shaped.

FIG. 7 is a sectional view of a closed die containing another specimen.

FIG. 8 is an elevation view of the specimen in FIG. 7 after it has been shaped.

FIG. 9 is a sectional view of a closed die containing another specimen.

FIG. 10 is an elevation view of the specimen in FIG. 9 after it has been shaped.

FIG. 11 is a perspective view of a specimen showing squirming instability.

FIG. 12 is a graph of elongation versus percent increase in area by cold working a 91% tungsten powder alloy.

FIG. 13 is a graph of ultimate tensile strength versus percent increase of cross-sectional area by cold working a 91% tungsten powder alloy.

FIG. 14 is graph of hardness versus percent increase in cross-sectional area by cold working a 91% tungsten alloy.

DETAILED DESCRIPTION

Referring to the drawing in detail, wherein like numerals indicate like elements, there is shown in FIG. 1 a portion of a press 10 having a confined chamber 12 defined at its ends by walls 14 and 16. At least one of the walls, such as wall 16 is moveable toward and away from the wall 14. Within the chamber 12, there is provided a specimen 18 of a metal to be cold worked.

The specimen 18 is preformed with a cylindrical shape. The chamber 12 defines the desired peripheral final shape for the specimen and likewise in this embodiment is a cylinder. Wall 16 engages one end face of the specimen 18 which is at room temperature and applies a continuous compressive force with a sufficient magnitude to force the preshaped specimen 18 to deform and fill the chamber 12 at the end of the compressive stroke. The specimen 18 simultaneously decreases length while maintaining its volume so as to have a final shape as shown in FIG. 2 and designated 18'. The compressive forces of wall 16 are applied sufficiently slowly so that the yield strength of the specimen 18 progressively increases. This in turn requires the compressive forces to progressively increase in magnitude as the yield strength increases until the entire circumference of the specimen 18 contacts the walls of chamber 12 and attains the desired final shape at the end of the compressive stroke as shown in FIG. 2.

In virtually every engineering design problem encountered in real life situations, engineers and scientists strive for designs that preclude loading of columns or columnar type structures to levels where buckling can occur. Such column buckling has been well-known for 200 years.

Mathematical criteria for column buckling was first developed by L. Euler in 1744, and the governing equation has since been known as the Euler equation. It states simply that a column must attain a certain length before it can be bent by its own or an applied weight.

The Euler formula has withstood the test of time. Originally it was stated as (1)

$$FL^2 > 4\pi^2 B,$$

where

F=load in pounds (lbs.)

L=length in inches

B=Flexural rigidity=EI(Lb-in$^2$), where

E=Youngs Modulus of elasticity (Lb/in$^2$)

I=Moment of inertia about the axis of bending (in$^4$).

(1) A. E. H. Love, Mathematical Theory of Elasticity, Dover Publications 1974

In its present day form, the equation (2) is given as $$W_{CR} = K_C \frac{EI}{L^2}$$

where $W_{CR}$=Critical Load beyond which buckling will occur, and $K_C$=is a constant which depend upon the manner of support and loading.

In fact, the value of $K_C$ for clamped or supported end conditions with axial load is given (2) as 39.48 which is exactly equal to $4\pi^2$, so that (2) Alexander Blake, Practical Stress Analysis in Engineering Design, Marcel Dekker, Inc. 1982.

$$W_{CR} = 4\pi^2 \frac{EI}{L^2}$$

is exactly the Euler equation.

It is a fact emphasized in the literature that the critical buckling load $W_{CR}$ is proportional to the Modulus of Elasticity E, section moment of inertia I, and inversely proportional to column length squared $1/L^2$, and is independent of yield strength of the material. It is further emphasized that critical buckling occurs at stress below uniaxial yield stress values.

I uniquely found that the amount of deformation force necessary to achieve the desired final geometry, and thus mechanical properties, can be achieved by exploiting those elements of column buckling which Engineering text books define as the forbidden zones. For example, a tungsten alloy specimen with a diameter of 0.32 inches was placed in a press die having a diameter of 0.38 inches and compressive force applied axially. After compressing approximately 25% of the total deformation, it was found that deformation was not uniform compression. Rather, deformation occurred by apparent buckling until the die wall restraint was encountered after which the specimen continued to deform in a spiral-like fashion with quite uniform pitch from end to end. See FIG. 11. Final deformation occurred by compressive stress. For ease of reference, I define this spiral deformation cycle as squiriming instability followed by compression until final geometry is achieved.

In a typical example, specimen 18 was sintered from a 94% powder tungsten base powder alloy with a length of 5.49 inches and a diameter of 0.345 inches. The specimen 18' had a length of 4.50 inches and a diameter of 0.381 inches. Hardness was very uniform along its entire length and varied between 39 and 40 $R_c$.

In FIG. 3, there is illustrated a different specimen 20 in the chamber 12. Specimen 20 was smaller in diameter than specimen 18 and formed the specimen 20' after compression and cold working. The effect on hardness was substantially the same as that attained in connection with FIGS. 1 and 2. However, as the percentage of cold working increased, the hardness likewise increased. See FIG. 14.

In FIG. 5 there is shown a similar specimen 24 in the chamber 12. Specimen 24 is in the form of a truncated cone made from 94% powder tungsten alloy. After compression, the resultant specimen 24' is a cylinder but its hardness progressively increases in a direction from its upper end to its lower end in FIG. 6 where the $R_A$ readings at A, B and C were 66, 69 and 72. The tensile strength at A was 135,000 psi with 25% elongation and at C was 200,000 psi with 2% elongation.

In FIG. 7, the press 38 has a chamber defined by cylindrical portion 40 and conical portion 42. The chamber is closed by a movable wall 44. Specimen 48 is a cylinder having a length greater than the length of the cylindrical portion 40 and having one flat end and a tapered end. The diameter of the cylindrical specimen 48 is substantially less than the diameter of cylindrical portion 40. After compression, there is formed specimen 48' having a cylindrical portion 50 and a tapered portion 52. The tapered portion 52 conforms to the shape of the tapered portion 42 of the chamber while the cylindrical portion 50 conforms to the shape of the cylindrical portion 40 of the chamber. The hardness along cylindrical portion 50 of specimen 48' was as follows. After compression, on specimen 48' the hardness of zone AB did not change, hardness increased from B to C, and was maximum from C to D.

In FIG. 9, there is shown a similar press 26 having movable walls 28 and 29 defining a confined cylindrical chamber 30. The specimen 36 has a cylindrical portion 33 and a tapered portion 25. After compression, the specimen 36' exhibited a uniform hardness of 69.5 $R_A$ from A to B and gradually increasing hardness from B to C where the hardness at C was 72 $R_A$.

FIG. 12 is a graph of elongation versus percent change of cross-sectional area wherein the final size of the specimen was 0.364 inches in diameter and 4.50 inches long. FIG. 13 illustrates a relationship between ultimate tensile strength and percent change in cross-sectional area for the last mentioned specimen.

The preformed metal specimens may be made by consolidating powder containing tungsten by a process known generally as cold pressing and sintering. Sintering of powder includes consolidating powdered metal by a number of variations including hot sintering, sintering with pressure and known a hot pressing, sintering without pressure, and hot isostatic pressing.

With respect to a composite such as copper tungsten, the percentage of copper may vary over a wide range such as 5 to 50%. Favorable results were attained using 70% tungsten and 30% copper powders processed as set forth above.

Test results have shown that there is no difference if only one of both of the walls at opposite ends of the chamber move. The rate of forming was not a significant factor. Substantially identical results were attained when the specimen was offset with respect to the axis of the chamber as opposed to being disposed along the axis of the chamber. In all cases, the hardness increased in proportion to cold working as shown in FIG. 14.

The present invention facilitates variation in the hardness in a predetermined manner at a predetermined location along the length of the specimen. No special tooling is required for practicing the present invention. Thus, the invention may be practiced on a conventional hydraulic or mechanical press. The present invention can more efficiently and economically perform functions which were attained heretofore by swaging or forging while achieving features which cannot be attained by those methods such as excellent surface finish, minimum scrap end losses, closely controlled diameter and length, producing bars with controlled variable mechanical properties.

The procedure for production of a simple cylinder such as specimen 18' is as follows. Determine the desired compressed diameter and length as defined by diameter $D_2$ and length $L_2$. On the basis of the strength required, determine the necessary change in area, for example from the graph of FIG. 13, then select diameter $D_1$ as required. Calculate the initial length $L_1$ from the constant volume formula:

$$L_1 = \frac{L_2 (D_2)^2}{(D_1)^2}$$

Fabricate the specimen to dimensions $D_1$ and $L_1$. Then compress the specimen in a closed chamber as described above.

Thus, the present invention facilities custom designing of the cold working of metals to a pre-determined strength. The rate of movement of the movable wall 16 may vary as desired depending upon the hardness of the materials involved. Typical speed of movement of wall 16 is in the range of 0.05 inches to 200 feet per minute. Most metals can be processed at a rate of 3 to 10 inches per minute.

The metal for the aforesaid specimens may be a tungsten powder alloy or composite. Metals such as copper and silver do not alloy with tungsten but instead permeate the intertices of tungsten to form a hard dense composite. Composites are also known as infiltrated structures. The hardness of such tungsten alloys or composites enables them to be used in environments not suitable if the metal were aluminum.

A suitable example of a tungsten powder alloy has the following weight percentages:

| | |
|---|---|
| tungsten | 91.080 |
| nickel | 4.999 |
| iron | 2.129 |
| cobalt | 1.000 |
| copper | .693 |
| mangenese | .099 |

A suitable method of producing a preformed specimen, in accordance with the last mentioned example, is as follows. The powders were uniformly blended for 1½ hours in a high intensity mill. The blended powders were consolidated into bars using a hydrostatic pressure of about 20,000 psi. The thusly produced bars had a diameter of 1.10 inches and a length of 29.5 inches. The bars were then sintered in a $DNH_3$ atmosphere at 2650° F. for about one hour. The sintered bars had a diameter of about 0.91 inches and a length of about 25 inches.

The sintered bars had an ultimate tensile strength of 130,000 psi, elongation of 17% and a hardness of 28 Rc. The sintered bars were then vacuum heat treated for about 10 hours at 2020° F. with a 0.1 micron vacuum. The thusly treated sintered bars had an ultimate tensile strength of 136,000 psi, elongation of 30% and a hardness of 28 Rc. The bars were then machined to form a preshaped specimen having a diameter of 0.724 inches and a length of 21.942 inches.

The preshaped specimen was lubricated with a zinc stearate solution. Thereafter the preshaped specimen was introduced into a confined chamber having a diameter of 0.775 inches. A pressure of about 200,000 psi at a speed of about 1 inch/min was applied to the specimen as described above. The final shape of the specimen corresponded to the shape of the chamber. The final size of the specimen was 0.775 inches in diameter and a length of 19.220 inches. The properties of the final product included an ultimate tensile strength of 161,000 psi, an elongation of 10% and a uniform hardness of 39 Rc.

With respect to a composite, the percentage of copper may vary over a wide range such as 1 to 50%. Favorable results were attained using 70% tungsten and 30% copper powders processed a set forth above.

The present invention may be embodied in other specific forms without departing from the spirit or essential attributes thereof and, accordingly, reference should be made to the appended claims, rather than to the foregoing specification, as indicating the scope of the invention.

I claim:

1. A method for increasing strength and/or controlling mechanical properties of powder metals and alloys comprising (a) consolidating powder to produce a metal specimen with a preshape and dimensions determined on the basis of the desired strength or mechanical properties, (b) introducing said preshaped specimen into a confined chamber which defines the desired peripheral final shape, spacing at least a portion of the periphery of said preshaped specimen from at least a portion of the walls defining said chamber with the relative dimensions of the spacing being governed by the amount of cold work needed to achieve desired strength or mechanical properties in that portion of the specimen, (c) engaging one face of said specimen with at least one moveable wall of said chamber and applying a continuous compressive force by said wall with a sufficient magnitude to force the preshaped specimen to deform and fill the chamber at the end of the compressive stroke while simultaneously decreasing length and maintaining the volume of the specimen constant, and (d) applying said compressive force by moving said moveable wall of the chamber sufficiently slowly so that the yield strength of the specimen progressively increases, and progressively increasing the magnitude of said force as the yield strength increases until the entire circumference of the specimen contacts the walls of the chamber and attains said desired final shape at the end of the compressive stroke of said movable wall.

(e) applying steps (c) and (d) in a manner so as to cause buckling of the specimen and produce an article at the end of the compressive stroke which has a predetermined property at a predetermined location.

2. A method in accordance with claim 1 including using a pre-shaped specimen whose length is substantially greater than its transverse dimensions.

3. A method in accordance with claim 1 including using a specimen which at least in part is non-cylindrical.

4. A method in accordance with claim 1 including using a confined chamber which at least in part is conical.

5. A method in accordance with claim 1 including deforming the specimen so that all transverse areas increase by the same percentage during compression.

6. A method in accordance with claim 1 wherein the speed of the movable wall is sufficiently slow as to cause the specimen to exhibit squiriming instability as it increases in transverse dimensions.

7. A method in accordance with claim 1 wherein the speed of the movable wall is in the range of 3 to 10 inches per minute.

8. A method in accordance with claim 1 wherein step (a) includes consolidating tungsten powder in an amount whereby the specimen is at least 90% tungsten.

9. A method in accordance with claim 1 including retaining substantially the original hardness at one end of the specimen.

10. A method in accordance with claim 1 where step (a) is performed in a manner so that steps (c) and (d) produce a specimen whose hardness varies along its length in a predetermined range.

11. A method in accordance with claim 1 wherein the area distribution of the chamber along its axis changes from a geometric figure to a point.

12. A method in accordance with claim 1 wherein step (a) includes sintering powders of tungsten, nickel, iron and cobalt.

13. A method in accordance with claim 12 wherein said powders also include copper and a trace of manganese.

14. A method in accordance with claim 12 wherein the preformed specimen has a length to diameter ratio of at least 5 to 1.

15. A method in accordance with claim 1 wherein step (a) includes consolidating powders of tungsten and copper so that the specimen is a composite.

16. A method in accordance with claim 1 including using a pre-shaped specimen whose length is substantially greater than its transverse dimensions, moving said movable wall at a speed which is sufficiently slow so as to cause the specimen to exhibit squirming instability as it increases in transverse dimensions, and step (a) being performed in a manner so that steps (c), (d) and (e) produce a specimen wherein said property is hardness which varies along the length of the specimen in a predetermined range.

17. A method in accordance with claim 1 wherein the steps (c), (d) and (e) are applied in a manner so as to produce an article at the end of the compressive stroke which has a predetermined strength at a predetermined location.

* * * * *